US007661978B2

(12) United States Patent
Kobayashi

(10) Patent No.: US 7,661,978 B2
(45) Date of Patent: Feb. 16, 2010

(54) CONNECTOR AND TO A CONNECTING METHOD

(75) Inventor: Yutaka Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/335,629

(22) Filed: Dec. 16, 2008

(65) Prior Publication Data

US 2009/0163059 A1 Jun. 25, 2009

(30) Foreign Application Priority Data

Dec. 25, 2007 (JP) ..... 2007-332221

(51) Int. Cl.
*H01R 13/62* (2006.01)

(52) U.S. Cl. ..... 439/372; 439/347; 439/157; 439/342

(58) Field of Classification Search ..... 439/372, 439/347, 157, 342
See application file for complete search history.

(56) References Cited

U.S. PATENT DOCUMENTS 5,727,959 A * 3/1998 Yagi et al. ..... 439/157
6,142,800 A 11/2000 Iwahori
2005/0098419 A1 5/2005 Matsui et al.

* cited by examiner

*Primary Examiner*—Ross N Gushi
(74) *Attorney, Agent, or Firm*—Gerald E. Hespos; Anthony J. Casella

(57) ABSTRACT

A connector (10) has a housing (20) that is connectable with a mating connector (90). A sliding force multiplying mechanism can slide relative to the housing (20) in a direction intersecting a connecting direction for proceeding with a first part of a connecting operation. A rotating force multiplying mechanism then can be rotated relative to the housing (20) for proceeding with a second part of the connecting operation. The sliding force multiplying mechanism and the rotating force multiplying mechanism operate separately and are formed on a single lever (40).

14 Claims, 8 Drawing Sheets

CONNECTOR AND TO A CONNECTING METHOD

BACKGROUND OF THE INVENTION

1. Field of the Invention

The invention relates to a connector and to a connecting method therefor.

2. Description of the Related Art

U.S. Pat. No. 6,142,800 discloses a connector with a housing that is connectable with a mating connector. Both a slide and a rotation lever are mounted in the housing and either can be operated to facilitate connection of the housing with the mating connector. The slide is driven forcibly when the lever is rotated.

The lever disclosed in U.S. Pat. No. 6,142,800 is rotated during the entire connecting operation, and a large operation force is required unless a sufficient angle of rotation of the lever can be ensured. Thus, the teaching of U.S. Pat. No. 6,142,800 presents problems when applied to a connector that requires a large connection force during a connecting operation.

The invention was developed in view of the above situation, and an object thereof is to provide a connector with a force multiplying mechanism that can be used even if the connector requires a large connection force.

SUMMARY OF THE INVENTION

The invention relates a connector with a housing that is connectable with a mating connector. The connector has a sliding force multiplying mechanism that can be moved relative to the housing in a direction intersecting a connecting direction with the mating housing for proceeding with a connecting operation. The connector also has a rotating force multiplying mechanism that can be rotated relative to the housing for proceeding with the connecting operation. The sliding force multiplying mechanism and the rotating force multiplying mechanism operate separately or independently. Thus, a part of the connecting operation can be performed by the sliding force multiplying mechanism and a corresponding margin can be given upon setting the rotating force multiplying mechanism. As a result, by setting a large angle of rotation, it is possible to deal with a case requiring a large connection force.

The rotating force multiplying mechanism may operate after the sliding force multiplying mechanism. Thus, an initial connection stage requiring a small connection force is performed efficiently by the sliding force multiplying mechanism and a final connection stage requiring a large connection force is performed by the rotating force multiplying mechanism.

The sliding force multiplying mechanism and the rotating force multiplying mechanism preferably are formed on a single lever. Thus, the construction can be simplified as compared with the case where separate levers are provided for the respective mechanisms.

The lever preferably is movable between a movement starting position and a movement ending position relative to the housing by the sliding force multiplying mechanism and is rotatable relative to the housing between a rotation starting position and a rotation ending position by the rotating force multiplying mechanism. Thus, the lever can be rotated smoothly from the rotation starting position to the rotation ending position after being moved from the movement starting position to the movement ending position.

The movement ending position and the rotation starting position preferably are at substantially the same position. Thus, the swiftness of the operation can be ensured.

Alternatively, a transition area may be provided between the movement ending position and the rotation starting position where the connecting operation with the mating connector does not proceed. A structure corresponding to the transition area and unrelated to the connecting operation does not hinder the connecting operation. Thus, a degree of design freedom can be improved.

The transition area preferably is provided in or adjacent to the slide means and extends at an angle to the connecting direction at the movement ending position. Thus, the angle of rotation of the lever is not restricted and a large angle of rotation of the lever can be ensured.

A shaft preferably is provided on one of the lever and the housing as the center of rotation of the lever and a bearing is provided on the other of the lever or the housing and engageable with the shaft. The bearing preferably is a long groove extending in an operating direction of the sliding force multiplying mechanism to permit a displacement of the shaft in an operation process of the sliding force multiplying mechanism. Thus, smooth movements are ensured.

A shaft accommodating chamber preferably is provided in the bearing substantially at the center of rotation of the lever and accommodates the shaft while having its movement prevented during operation of the sliding or rotating force multiplying mechanism. Thus, the lever will not displace from its center of rotation.

At least one shaft retaining portion preferably is provided on at least one groove surface of the bearing and resiliently contacts the shaft to permit passage of the shaft before the shaft enters the shaft accommodating chamber and for preventing a returning movement of the shaft after the shaft is accommodated into the shaft accommodating chamber. The transition area may be provided in correspondence with this shaft retaining portion.

The shaft preferably slides substantially along the groove surface of the bearing in the operation process of the sliding force multiplying mechanism. Thus, the displacement of the shaft also functions to guide the movement of the sliding force multiplying mechanism.

At least one slide groove preferably is formed on the lever. Thus, the connecting operation proceeds by engaging a follower pin on the mating connector with the slide groove and then with the one rotation groove. Accordingly, the construction of the mating connector can be simplified. The transition area may be formed in the slide groove.

The slide groove and the rotation groove preferably communicate with each other. Thus, it is not necessary to prepare separate follower pins for the slide groove and for the rotation groove and the continuity of a force multiplying operation can be ensured.

At least one escaping groove preferably is formed continuously with the guide groove for permitting displacement of the guide pin during operation of the rotating force multiplying mechanism.

An escaping groove preferably is formed continuously with the guide groove for permitting displacement of the guide pin in the operation process. Thus, the lever can be rotated smoothly.

An operable portion of the lever preferably can be used both during the operation by the sliding force multiplying mechanism and during the operation by the rotating force multiplying mechanism. Thus, it is not necessary to grip the operable portion differently upon transferring from the sliding force multiplying mechanism to the rotating force multiplying mechanism.

The operable portion of the lever preferably includes a slide operation surface for receiving an operator's fingers during the operation by the sliding force multiplying mechanism. The operation portion also includes a rotation operation surface separate from the slide operation surface for receiving an operator's fingers during the operation by the rotating force multiplying mechanism. Thus, the concentration of the operation force on one point of the finger in the process of the connecting operation can be avoided.

The invention also relates to a method of connecting a connector with a mating connector. The method comprises positioning a housing of the connector in opposed relationship to the mating connector so that the housing and the mating connector can be moved toward one another along a connecting direction. The method then comprises partly engaging a force multiplying member of the connector with part of the mating connector. The method proceeds by sliding the force multiplying member relative to the housing in a direction intersecting the connecting direction for displaying a sliding force multiplying action that partly connects the connector and the mating connector. The method then rotates the force multiplying member relative to the housing for displaying a rotating force multiplying action that completes a connection of the connector and the mating connector. Thus, the sliding force multiplying action and the rotating force multiplying action are displayed separately.

The force multiplying member may be a lever that is moved between a movement starting position and a movement ending position relative to the housing to display the sliding force multiplying action. The lever then can be rotated relative to the housing between a rotation starting position and a rotation ending position to display the rotating force multiplying action.

The movement ending position and the rotation starting position may be at substantially the same position or alternatively a transition area may be defined between the movement ending position and the rotation starting position where the connecting operation with the mating connector does not proceed. The transition may extend at an angle to the connecting direction at the movement ending position.

A shaft preferably is provided on one of the lever and the housing and defines the center of rotation of the lever. A bearing preferably is provided in the other of the lever and the housing and is engageable with the shaft. The bearing preferably is a long groove extending in an operating direction of the sliding force multiplying action to permit a displacement of the shaft in a sliding force multiplying process.

The method preferably prevents movement of the shaft along the bearing during the operation of the rotating force multiplying action.

The method may further comprise resiliently contacting a shaft retainer of the bearing with the shaft to permit passage of the shaft before the shaft has its movement prevented and for preventing a returning movement of the shaft during the operation of the rotating force multiplying action.

The shaft preferably slides on a groove surface of a bearing during operation of the sliding force multiplying mechanism.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
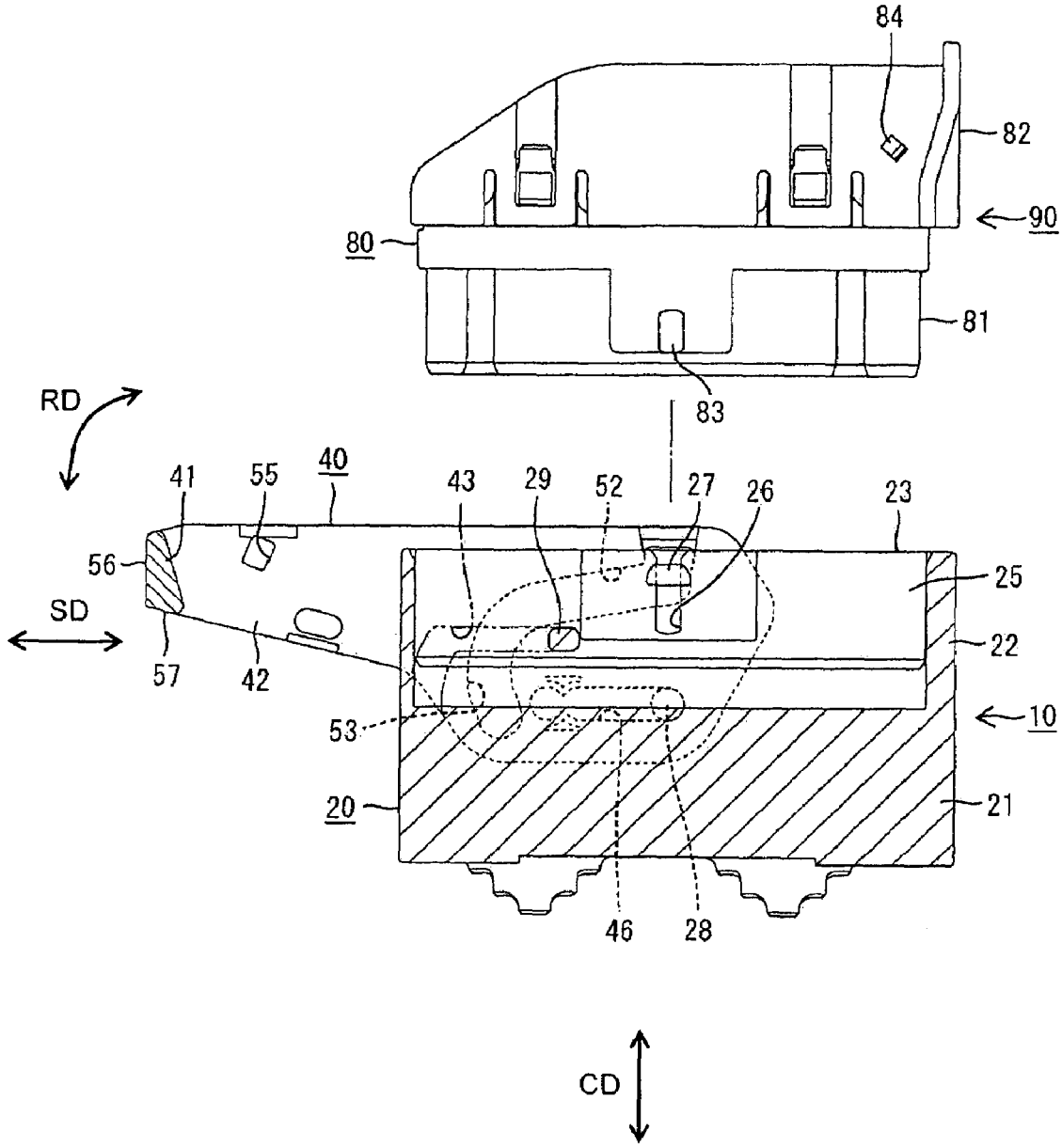
FIG. 1 is a side view partly in section showing a state before two housings are connected in a first embodiment of the invention.

A connector according to a first embodiment of the invention is identified by the numeral 10 in FIGS. 1 to 8. The connector 10 has a housing 20 connectable with a mating connector 90. In the following, a connecting end of the two connectors 10, 90 is referred to as the front.

The mating connector 90 has a female housing 80 made e.g. of synthetic resin for accommodating female terminal fittings (not shown). As shown in FIG. 1, the female housing 80 has a long block-shaped terminal accommodating portion 82 and a substantially cap-shaped wire cover 82 mounted on a cover mounting portion at a rear part of the terminal accommodating portion 81. Follower pins 83 project from longitudinal intermediate parts of the opposite side surfaces of the female housing 80. The follower pins 83 have a narrow oblong cross-sectional shape that is long in forward and backward directions (connecting direction CD). Lever locks 84 project from opposite outer surfaces of the wire cover 82.

The housing 20 is made e.g. of synthetic resin and includes a main body 21 for accommodating male terminal fittings (not shown). A vertically long tubular receptacle 22 projects forward from the outer periphery of the front surface of the housing main body 21. Tabs of the respective male terminal fittings project into the receptacle 22 and a moving plate 23 is assembled into the receptacle 22. The moving plate 23 can be pushed by the female housing 80 as a connecting operation proceeds and displaced back along the connecting direction CD while protecting the tabs.

The moving plate 23 includes a substantially plate-shaped front wall 24 substantially facing the back surface of the receptacle 22 and a surrounding wall 25 projecting forward from the outer periphery of the front wall 24. The outer surface of the surrounding wall 25 can slide on the inner surface of the receptacle 22. Two introducing grooves 26 open at the front ends of the opposite sides of the surrounding wall 25 and extend forward and backward along the connecting direction CD for receiving the follower pins 83. Further, two arches 27 are provided on the opposite sides of the surrounding wall 25 and cross over the respective introducing grooves 26 at intermediate positions. Mount spaces are defined at the inner sides of the arches 27 for receiving the follower pins 83.

The follower pins 83 are fit into the mount spaces so that the arches 27 and the follower pins 83 are united to act together. Grooves (not shown) are formed in the front end edges of the opposite side walls of the receptacle 22 for receiving the follower pins 83 and the arches 27.

Substantially cylindrical shafts 28 project in central parts of the outer surfaces of the opposite side walls of the housing 20 at positions near the front end of the housing main body 21.

Guide pins 29 project out at positions before the shafts 28 on the outer surfaces of the opposite walls of the housing 20 and substantially in the center of the receptacle 22. The guide pins 29 are slightly smaller than the shafts 28 and have substantially cylindrical shapes with a somewhat vertically longer cross section. Straight sections 31 are defined on the longer sides of each guide pin 29 facing each other and substantially parallel to each other.

The connector 10 also includes a lever 40 that is made e.g. of synthetic resin. The lever 40 is substantially U-shaped and includes an operable portion 41 extending in a width direction. Two substantially parallel arms 42 project substantially perpendicularly from opposite ends of the operable portion 41. The lever 40 is supported on the shafts 28 to straddle the housing 20. More particularly, the lever 40 is slidable in a sliding direction SD substantially orthogonal to the connecting direction CD between a movement starting position MSP and a movement ending position MEP. The lever 40 also is rotatable about the shafts 28 between a rotation starting position RSP and a rotation ending position REP. In this embodiment, the movement ending position MEP and the rotation starting position RSP substantially coincide. As explained herein, the lever 40 has both a sliding force multiplying mechanism and a rotating force multiplying mechanism to assist connection of the housing 20 with the mating connector 90. The sliding force multiplying mechanism functions from the movement starting position MSP to the movement ending position MEP, while the rotating force multiplying mechanism functions from the rotation starting position RSP to the rotation ending position REP.

Figure 6:
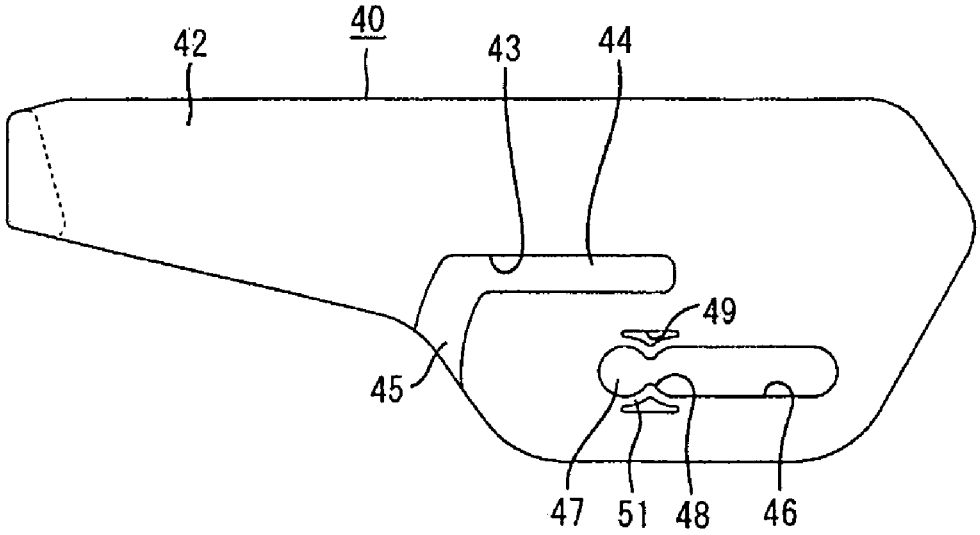
FIG. 6 is a side view of the lever.
Figure 7:
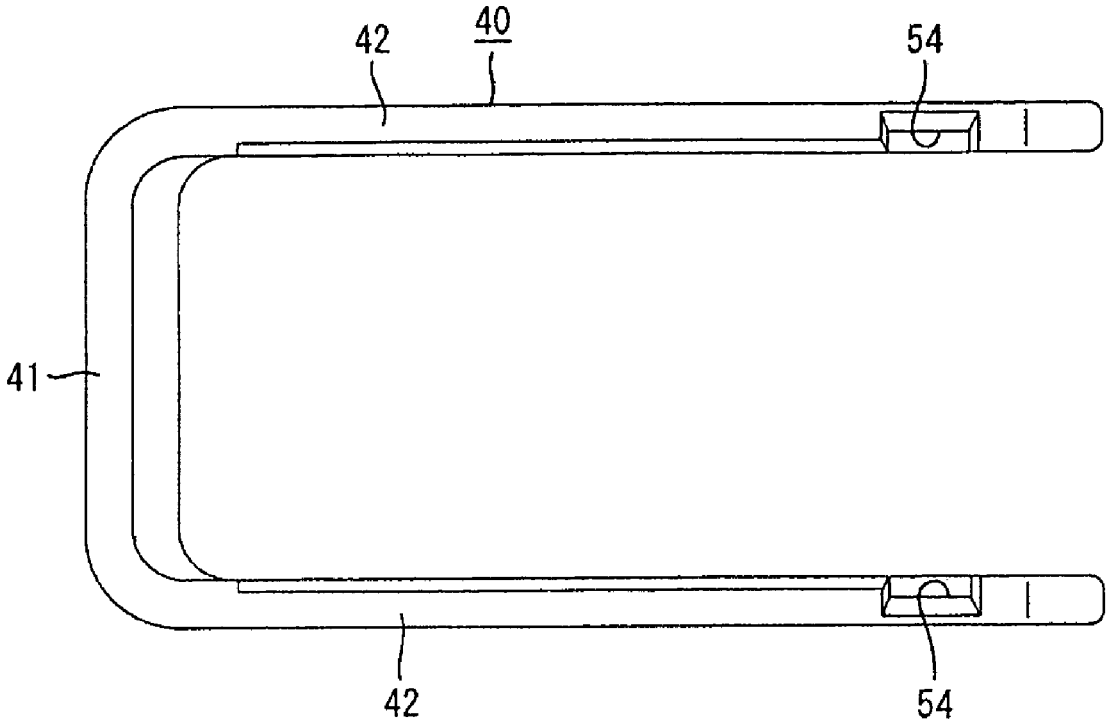
FIG. 7 is a front view of the lever.

As shown in FIG. 6, a guide groove 43 is formed in each of the arms 42 of the lever 40. Each guide groove 42 extends substantially in a sliding direction SD, which is the operating direction of the sliding force multiplying mechanism, and then in a rotating direction RD, which is the operating direction of the rotating force multiplying mechanism of the lever 40. More particularly, the guide groove 43 is comprised of a slide guide groove 44 corresponding to the sliding force multiplying mechanism and an escaping groove 45 corresponding to the rotating force multiplying mechanism. The slide guide groove 44 extends substantially horizontally in the sliding direction SD and substantially orthogonal to the connecting direction CD while the sliding force multiplying mechanism is operating. The width of the slide guide groove 44 is substantially equal to the corresponding shorter width dimension of the guide pin 29. Thus, the straight portions 31 of the guide pin 29 can slide on the opposed facing groove surfaces of the slide guide groove 44. On the other hand, the escaping groove 45 is substantially continuous with the back end of the slide guide groove 44 and extends along an arc substantially centered on the center of rotation of the lever 40. The back end of the escaping groove 45 opens at the outer periphery of the arm 42. The width of the escaping groove 45 exceeds the width of the slide guide groove 44 so that the guide pin 29 can fit loosely into the escaping groove 45.

Bearings 46 penetrate the arms 42 and are engageable with the shafts 28 of the housing 20. The bearings 46 are long grooves that extend substantially horizontally in the sliding direction SD and substantially parallel to the slide guide grooves 44 from starting ends where the shafts 28 are introduced at the movement starting position MSP toward the movement ending position MEP. The width along most of the bearings 46 is substantially equal to the diameter of the shafts 28. Thus, the shafts 28 can slide on the opposed facing groove surfaces of the bearings 46.

A shaft accommodating chamber 47 is provided near the back end of each bearing 46 for holding the shaft 28 at the rotation starting position RSP and preventing movement. The center of rotation of the lever 40 is defined with the shafts 28 accommodated in the respective shaft accommodating chambers 47. The groove surfaces of the bearing 46 project toward one another at a position before the shaft accommodating chamber 47 to narrow the groove width and to define a shaft retainer 48. Each shaft retainer 48 includes two slits 49 extending along opposite groove edges of the bearing 46. Spring pieces 51 are defined between the respective slits 49 and have arcuate shapes extending along the outer periphery of the shaft 28. The spring pieces 51 are resiliently deformable out in groove width directions to contact the shaft 28 in the shaft accommodating chamber 47 and to inhibit a movement thereof in a returning direction toward the movement starting position MSP.

Figure 5:
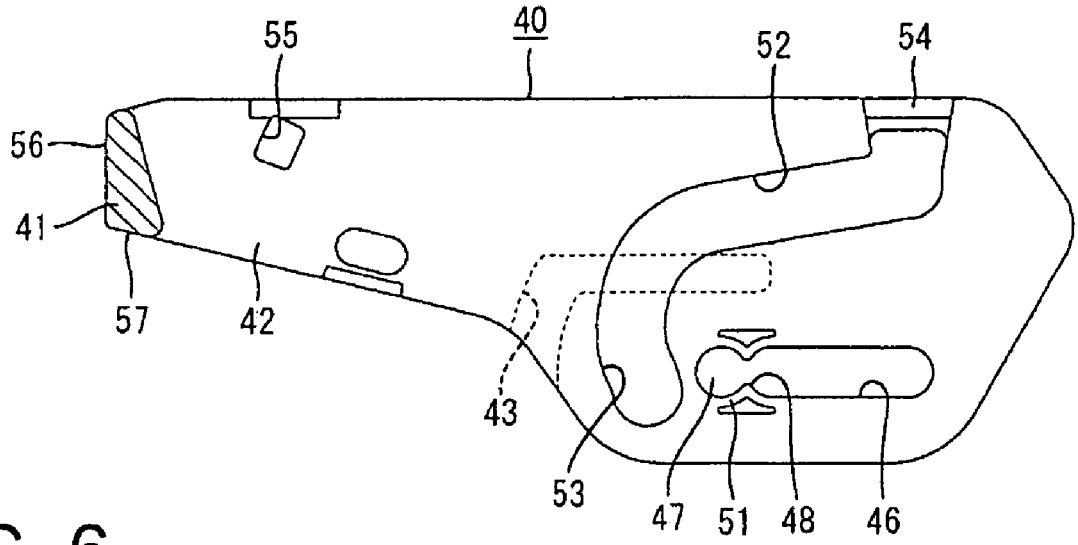
FIG. 5 is a side view in section of the lever.

As shown in FIG. 5, a slide groove 52 constituting part of the sliding force multiplying mechanism and a rotation groove 53 constituting part of the rotating force multiplying mechanism are formed on the inner surface of each of the arm portions 42. The follower pin 83 is engageable with the groove surfaces (cam surfaces) of the grooves 52, 53. An introduction opening 54 is formed on the inner surface of each arm 42 at or near an edge opposite to the edge where the escaping groove 45 opens, and the starting end of the slide groove 52 is connected unitarily with the back end of this introduction opening 54. The slide groove 52 extends substantially straight in the operating direction of the sliding force multiplying mechanism. Similarly, the rotation groove 53 extends substantially in an arcuate or bent manner in the operating direction of the rotating force multiplying mechanism with the starting end thereof unitarily connected with the back end of the slide groove 52. The rotation groove 53 is at such a position to overlap with the guide groove 43 (slide guide groove 44) in a thickness direction of the arm 42, and the back end of the rotation groove 53 is near the shaft accommodating chamber 47 of the bearing 46. Further, two lever interlocking portions 55 are formed by recessing the inner surfaces of the arms 42 and are engageable with the lever locks 84.

The operable portion 41 includes a slide operation surface 56 and a rotation operation surface 57 both of which can be operated by fingers of the operator. The slide operation surface 56 is a substantially flat surface facing in the sliding direction SD (i.e. its normal vector is oriented in the sliding direction SD) and is operated during the operation of the sliding force multiplying mechanism. The rotation operation surface 57 is a substantially flat surface adjacent to the slide operation surface 56 and substantially faces in the rotating direction (i.e. its normal vector is oriented substantially normal to the axis of rotation of the lever 40). The rotation operation surface 57 is operated during the operation of the rotating force multiplying mechanism.

Figure 8A:
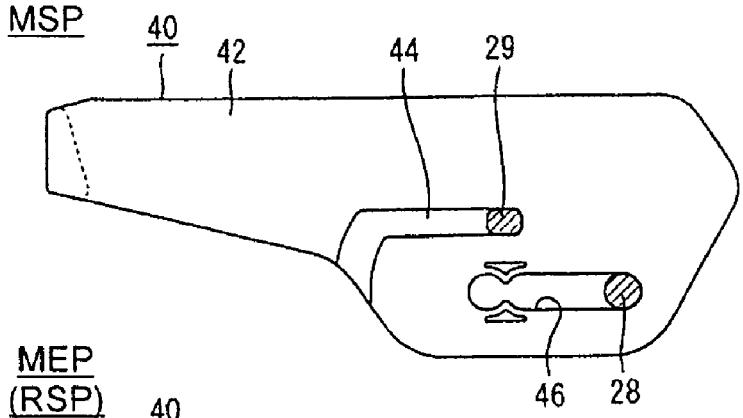
FIG. 8A is a side view showing a guide pin and a shaft portion at a movement starting position.
Figure 8B:
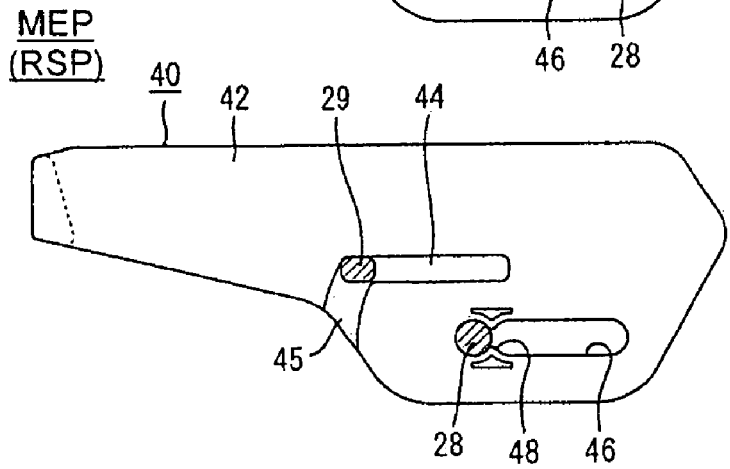
FIG. 8B is a side view showing the guide pin and the shaft portion at the movement ending position and FIG. 8C is a side view showing the guide pin and the shaft portion at a rotation intermediate position.

The connector 10 is used by initially positioning the lever 40 at the movement starting position MSP on the housing 20. Thus, as shown in FIG. 1, the operable portion 41 is distant from the housing 20 and the front edges of the arms 42 are arranged substantially along the front edge of the receptacle 22 so that the lever 40 is in a horizontal posture as a whole. At the movement starting position MSP, the guide pins 29 are near the starting ends of the guide grooves 43, the shafts 28 are near the starting ends of the bearings 46, the introduction openings 54 of the lever 40 face forward and the arches 27 are in the introduction openings 54, as shown in FIG. 8A. At this time, the moving plate 23 is near the opening side of the receptacle 22 and the leading ends of the tabs are protected by the front wall 24.

Figure 2:
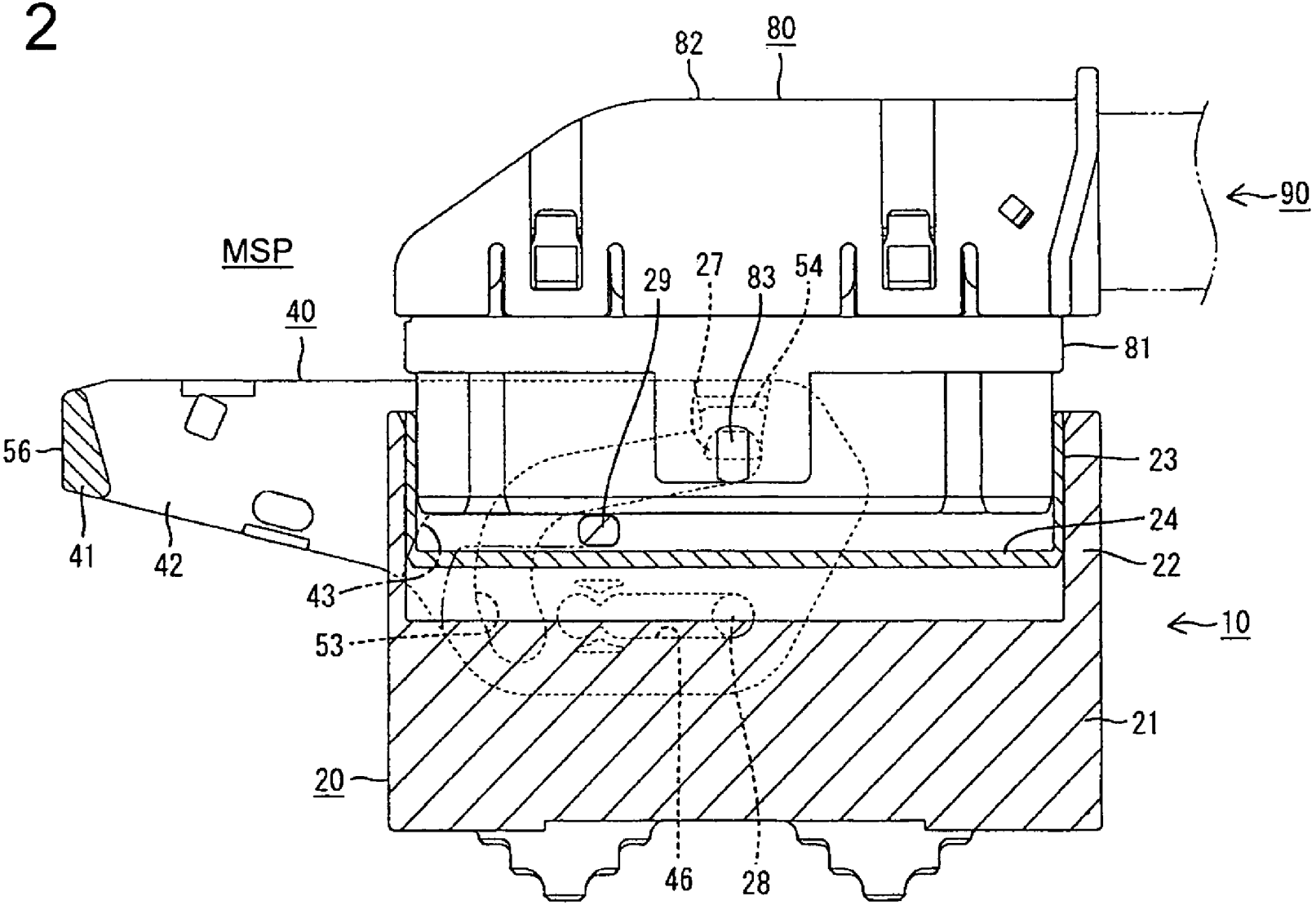
FIG. 2 is a side view partly in section showing a state where the two housings are lightly connected.

Subsequently, the housing 20 and the mating connector 90 are orientated to face each other and the female housing 80 is fit partly into the receptacle 22. Then, as shown in FIG. 2, the follower pins 83 enter the introduction openings 54 to unite with the arches 27, thereby partly connecting the housings 20, 80 and temporarily stopping the connecting operation.

Figure 3:
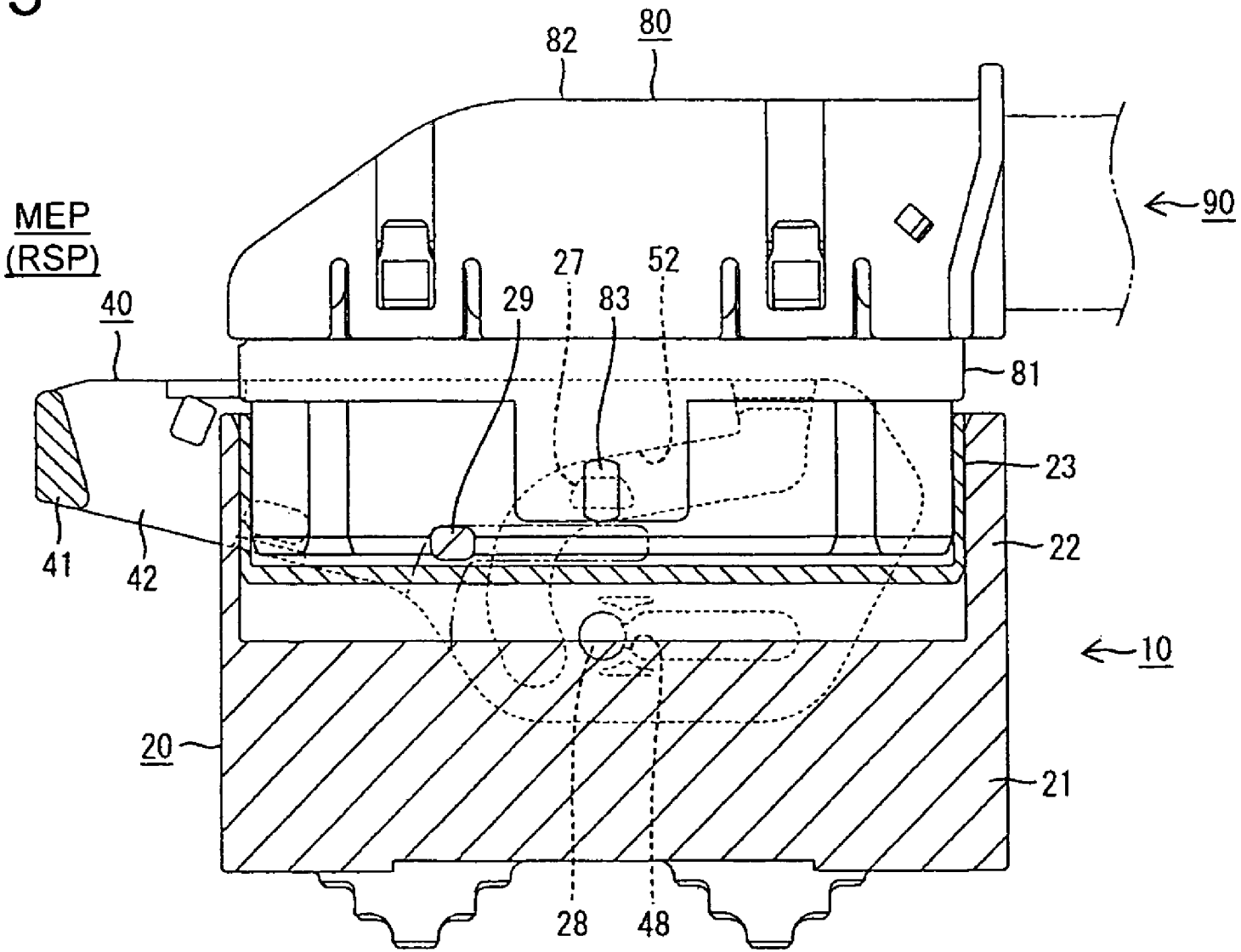
FIG. 3 is a side view partly in section showing a state attained by moving a lever to a movement ending position.

Fingers then are placed on the slide operation surface 56 of the operable portion 41 to move the lever 40 in the sliding direction SD toward the housing 20 and to the movement ending position MEP. Thus, the operable portion 41 approaches the housing 20 and the entire lever 40 is assembled deeply assembled into the housing 20, as shown in FIG. 3.

The follower pins 83 united with the arches 27 slide substantially on the groove surfaces of the slide grooves 52 as the lever 40 is moved from the movement starting position MSP to the movement ending position MEP. Thus, the sliding force multiplying mechanism operates and the housings 20, 80 are pulled toward each other with a small operating force. In the meantime, the guide pins 29 slide on the groove surfaces of the slide guide grooves 44 and the shafts 28 slide on the groove surfaces of the bearings 46 to ensure a movement in the sliding direction SD of the lever 40. The shafts 28 resiliently move over the shaft retaining portions 48 before the lever 40 reaches the movement ending position MEP. The shafts 28 are positioned in the shaft accommodating chambers 47 As the lever 40 reaches the movement ending position MEP when the shafts 28 pass the shaft retaining portions 48. Thus, the spring pieces 51 are displaced resiliently into the respective slits 49. At the movement ending position MEP (same as the rotation starting position MSP), the follower pins 83 are at the back ends of the slide grooves 52 together with the arches 27 to be located near the starting ends of the rotation grooves 53. Additionally, the guide pins 29 are near the back ends of the slide guide grooves 44 and near the starting ends of the escaping grooves 45.

Figure 4:
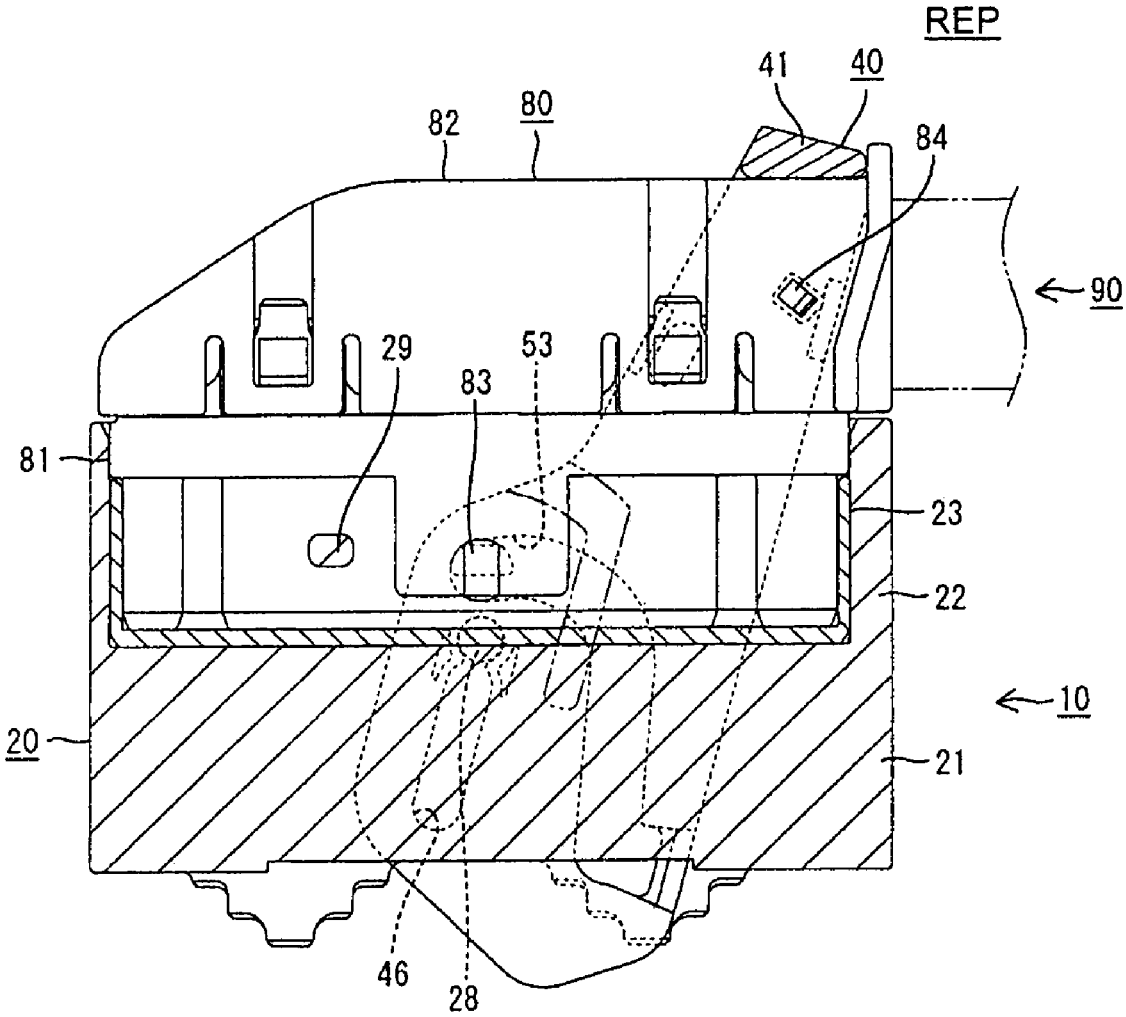
FIG. 4 is a side view partly in section showing a state attained by rotating the lever to a rotation ending position.

The operator then pushes the rotation operation surface 57 of the operable portion 41 of the lever 40 to rotate the lever 40 in the rotating direction RD about the shafts 28 in the shaft accommodating chambers 47 and toward the rotation ending position REP. Then, as shown in FIG. 4, the operable portion 41 vertically crosses behind the wire cover 82 of the female housing 80 to contact the wire draw-out side of the wire cover 82 and the lever locks 84 resiliently engage the lever interlocking portions 55 to hold the lever 40 at the rotation ending position REP.

Figure 8C:
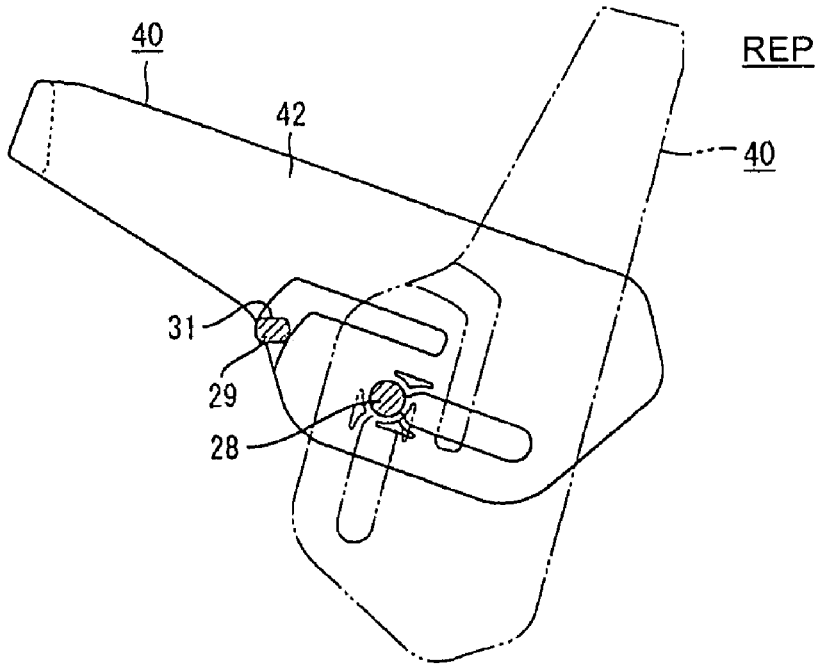

The follower pins 83 are united with the arches 27 and slide along the groove surfaces of the rotation grooves 53 as the lever 40 is rotated from the rotation starting position RSP to the rotation ending position REP. Thus, the rotating force multiplying mechanism operates and the two housings 20, 80 are pulled toward each other with a small operation force. In this case, an initial connection stage has already been completed by the above-described sliding force multiplying mechanism and the remaining stage is performed by the rotating force multiplying mechanism. Accordingly, the sliding force multiplying mechanism is distinct and does not act when the rotating force multiplying mechanism acts and vice-versa. As shown in FIG. 8C, the guide pins 29 exit to the outside of the arms 42 through the back ends of the escaping grooves 45 during rotation of the lever 40. The follower pins 83 remain united with the arches 27 and reach the back ends of the rotation grooves 53 when the lever reaches the rotation ending position REP. Thus, the female housing 80 is fit deeply into the receptacle 22 and the front wall 24 of the moving plate 23 approaches the back surface of the receptacle 22 with the female and male terminals electrically connected to proper depths. The two housings 20, 80 can be separated by pushing the operable portion 41 of the lever 40 strongly toward the rotation starting position RSP to disengage the lever locks 84 and the lever interlocking portions 55. The lever 40 then is rotated and slid in a reverse way.

As described above, the sliding force multiplying mechanism and the rotating force multiplying mechanism operate separately. Thus, a part of the connecting operation is performed by the sliding force multiplying mechanism and a corresponding margin can be given by the rotating force multiplying mechanism. As a result, it is possible to accommodate a case requiring a large connection force by setting a large angle of rotation of the lever 40.

The initial connection stage requires a small connection force and is performed by the sliding force multiplying mechanism. The final connection stage requires a large connection force and is performed by the rotating force multiplying mechanism. Thus, connection efficiency is good. Additionally the sliding force multiplying mechanism and the rotating force multiplying mechanism are formed on the single lever 40. Therefore, the construction is simplified as compared with the case where separate levers 40 are provided for the respective mechanisms.

Operation of the sliding force multiplying mechanism displaces the guide pins 29 along the groove surfaces of the guide grooves 43 and displaces the shafts 28 along the groove surfaces of the bearings 46. Thus, the lever 40 cannot deviate from a proper movement route.

The operable portion 41 of the lever 40 includes the slide operation surface 56 and the rotation operation surface 57 separate from the slide operation surface 56. Hence, the operation force is not concentrated on one point of the finger in the process of the connecting operation.

Figure 9:
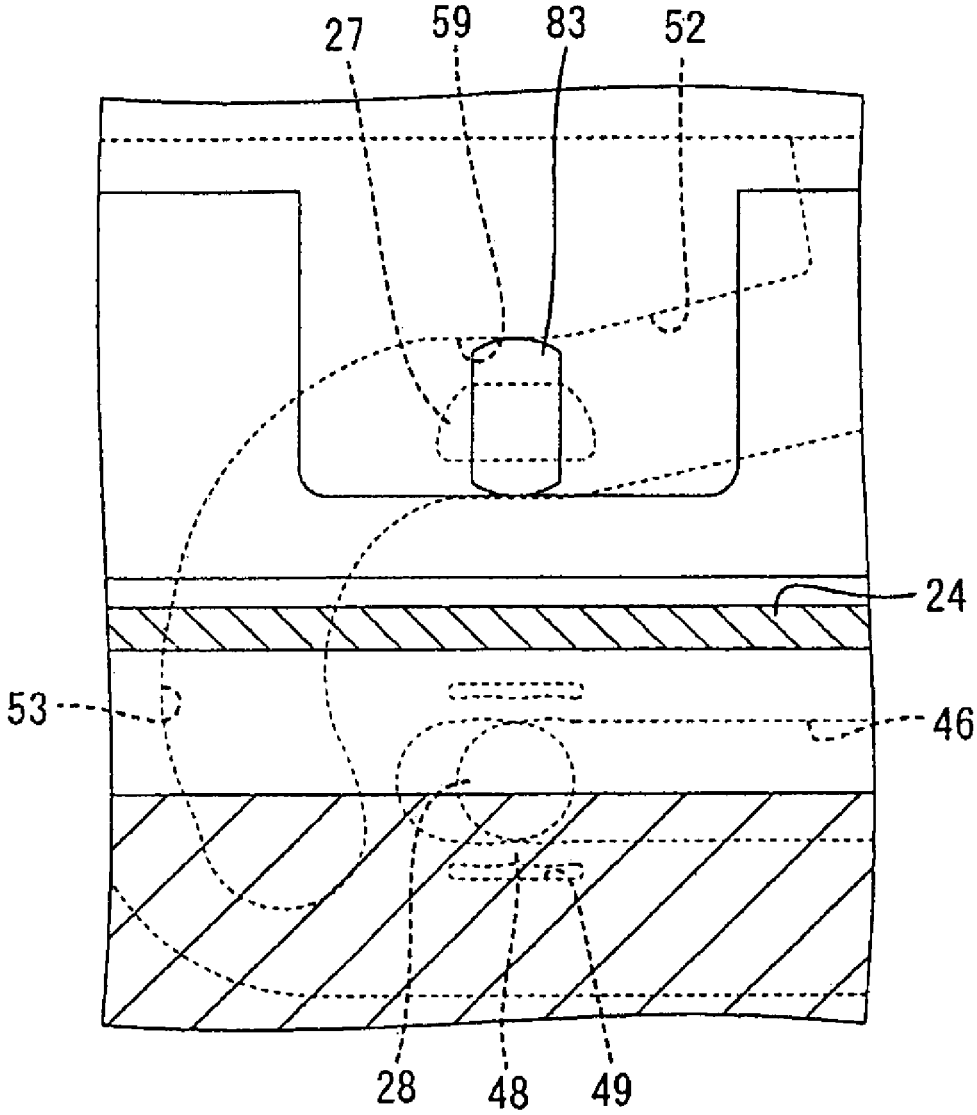
FIG. 9 is a side view partly in section enlargedly showing an essential state where a follower pin passes a transition area in a second embodiment.

A second embodiment of the invention is described with reference to FIG. 9. In the second embodiment, transition areas 59 are provided between the movement ending position MEP and the rotation starting position RSP of the lever 40. This transition areas 59 extend from the back ends of the slide grooves 52 in the sliding direction SD at an angle substantially orthogonal to the connecting direction CD at the movement ending position MEP (when the lever 40 is not yet rotated) to conform to the sliding direction SD of the sliding force multiplying mechanism. Thus, the two housings 20, 80 are held at a specified position in forward and backward directions without proceeding with the connecting operation or displacing along the connecting direction CD while the follower pins 83 pass the transition areas 59.

The shafts 28 contact the shaft retaining portions 48 and resiliently deform the shaft retaining portions 48 while the follower pins 83 pass the transition areas 59. The lever 40 enters a slightly unstable state due to the resilient deformations of the shaft retaining portions 48, but this does not hinder the connecting operation since the follower pins 83 are in the transition areas 59 and the connecting operation of the two housings 20, 80 does not proceed.

The above-described structure of the second embodiment corresponding to the transition areas 59 is unrelated to the connecting operation and does not hinder the connecting operation. Thus, a degree of freedom in designing is improved. Further, the transition areas 59 extend horizontally from the back ends of the slide grooves 52. Therefore, the angle of rotation of the lever 40 is not restricted in the rotating force multiplying mechanism and a large angle of rotation of the lever 40 can be ensured.

The present invention is not limited to the above described and illustrated embodiments. For example, the following embodiments are also embraced by the technical scope of the present invention.

The sliding force multiplying mechanism may operate following the rotating force multiplying mechanism.

A lever for the sliding force multiplying mechanism and a lever for the rotating force multiplying mechanism may be provided respectively. Additionally or alternatively, the lever may have a shape different from a U-shape, such as a substantially plate-like shape that can fit closely into a lever accommodation space in the housing of the connector.

The rotating force multiplying mechanism may be a lever for proceeding with the connection with the mating connector by a known rack-pinion mechanism. Further, the rotating force multiplying mechanism may be a known fulcrum lever.

The guide grooves may be formed in the housing and the guide pins may be provided on the lever.

The guide grooves and the guide pins may be omitted.

The shafts may be provided on the housing and the bearing portions may be formed in the lever.

The slide grooves and the rotation grooves need not communicate with each other, and the mating connector may include follower pins corresponding to both grooves. Moreover, the sliding path need not to be strictly linear, but may be slightly bent, curved, wiggled and/or have substantially linear segments being non-linear as a whole.

The moving plate may be omitted.

The lever may be mounted on the female housing.

The lever may move the moving plate.

What is claimed is:

1. A connector, comprising:

a housing connectable with a mating connector along a connecting direction;

a lever having an operable portion spaced from the housing and configured for receiving an operating force for urging the operable portion toward the housing, the lever further having a sliding force multiplying mechanism mounted to the housing for sliding movement in a direction intersecting the connecting direction in response to movement of the operable portion toward the housing for performing a first part of a connecting operation of the housing with the mating connector; and the lever further having a rotating force multiplying mechanism rotatable relative to the housing for performing a second part of a connecting operation of the housing with the mating connector, wherein the sliding force multiplying mechanism and the rotating force multiplying mechanism operate separately.

2. The connector of claim 1, wherein the rotating force multiplying mechanism operates following the sliding force multiplying mechanism.

3. The connector of claim 1, wherein the lever is movable relative to the housing between a movement starting position where the operable portion is spaced a first distance from the housing and a movement ending position where the operable portion is spaced a second distance from the housing during operation of the sliding force multiplying mechanism, the first distance being greater than the second distance, the lever further being rotatable relative to the housing between a rotation starting position and a rotation ending position during operation of the rotating force multiplying mechanism.

4. The connector of claim 3, wherein the movement ending position and the rotation starting position are at substantially the same position.

5. The connector of claim 1, wherein a shaft is provided on one of the lever and the housing and a bearing engageable with the shaft is provided in the other of the lever and the housing, the shaft defining the center of rotation of the lever, and the bearing being a groove extending in an operating direction of the sliding force multiplying mechanism to permit a displacement of the shaft during operation of the sliding force multiplying mechanism.

6. The connector of claim 5, wherein a shaft accommodating chamber is provided in the bearing substantially at the center of rotation of the lever for accommodating the shaft and restricting movement of the shaft during the operation of the rotating force multiplying mechanism.

7. The connector of claim 6, wherein at least one shaft retainer is provided in the bearing for resiliently contacting the shaft to permit the passage of the shaft before the shaft enters the shaft accommodating chamber and for preventing a returning movement of the shaft after the shaft is in the shaft accommodating chamber.

8. A connector of claim 7, wherein the shaft slides substantially on the groove surface of the bearing during operation of the sliding force multiplying mechanism.

9. The connector of claim 1, wherein the sliding force multiplying mechanism includes at least one slide groove in the lever for engaging a follower pin on the mating connector and proceeding with the first part of the connecting operation and wherein the rotating force multiplying mechanism includes at least one rotation groove in the lever for engaging the follower pin on the mating connector and proceeding with the second part of the connecting operation, the slide groove and the rotation groove communicating with each other.

10. The connector of claim 1, wherein at least one guide groove is formed in one of the lever and the housing and extends in an operating direction of the sliding force multiplying mechanism, at least one guide pin is provided on the other of the lever and the housing and slides along at least one groove surface of the guide groove during operation of the sliding force multiplying mechanism.

11. The connector of claim 10, wherein at least one escaping groove is formed continuously with the guide groove for permitting a displacement of the guide pin during operation of the rotating force multiplying mechanism.

12. The connector of claim 1, wherein the lever has an operable portion including a slide operation surface aligned for receiving a manual force for operating the sliding force multiplying mechanism, the operation portion further including a rotation operation surface separate from the slide operation surface and aligned for receiving a manual force for operating the rotating force multiplying mechanism.

13. A connector, comprising:

a housing connectable with a mating connector along a connecting direction;

a sliding force multiplying mechanism movable relative to the housing in a direction intersecting the connecting direction for performing a first part of a connecting operation of the housing with the mating connector; and a rotating force multiplying mechanism rotatable relative to the housing for performing a second part of a connecting operation of the housing with the mating connector, wherein the sliding force multiplying mechanism and the rotating force multiplying mechanism operate separately, the sliding force multiplying mechanism and the rotating force multiplying mechanism being formed on a single lever, the lever being movable relative to the housing between a movement starting position and a movement ending position during operation of the sliding force multiplying mechanism and being rotatable relative to the housing between a rotation starting position and a rotation ending position during operation of the rotating force multiplying mechanism, wherein a transition area where the connecting operation with the mating connector does not proceed is provided between the movement ending position and the rotation starting position, the transition area extends at an angle to the connecting direction at the movement ending position.

14. A method of assembling a connector with a mating connector, comprising the following steps:

positioning a housing of the connector in opposed relationship to the mating connector so that the housing and the mating connector can be moved toward one another along a connecting direction;

engaging a force multiplying member of the connector with part of the mating connector;

sliding the force multiplying member toward the housing in a direction intersecting the connecting direction for exerting a sliding force multiplying action that partly connects the connector and the mating connector; and rotating the force multiplying member relative to the housing for exerting a rotating force that completes a connection of the connector and the mating connector, whereby the sliding force and the rotating force exerted separately.

* * * * *